United States Patent [19]

Kruse

[11] Patent Number: 4,587,891

[45] Date of Patent: May 13, 1986

[54] VENTILATING DEVICE AND METHOD FOR MAKING THE SAME

[76] Inventor: Wilbur F. Kruse, 1641 Womer Dr., Wichita, Kans. 67203

[21] Appl. No.: 730,429

[22] Filed: May 6, 1985

[51] Int. Cl.[4] ..... F24F 7/00

[52] U.S. Cl. ..... 98/29; 98/31; 98/32; 98/37; 98/DIG. 6

[58] Field of Search ..... 98/29, 37, DIG. 6, 31, 98/32

[56] References Cited

U.S. PATENT DOCUMENTS

| | | | |
|---|---|---|---|
| 2,779,065 | 1/1957 | Rehme | 98/29 X |
| 2,782,464 | 2/1957 | Joppich | 98/29 X |
| 4,159,673 | 7/1979 | Weirich | 98/37 |
| 4,222,315 | 9/1980 | Weirich | 98/37 |

*Primary Examiner*—Lloyd L. King

*Attorney, Agent, or Firm*—John H. Widdowson; John W. Carpenter

[57] ABSTRACT

A venting device for ventilating new masonry, stone, precast veneer, or the like. The device comprises a conduit having an elongated body with a body wall and a first open end and a second open end. The first open end has a circumferential structure defining an inward flange with an inward edge that defines the meeting point of the inward flange and the inside surface of the body wall. The second open end has a circumferential structure defining a bevel. A generally cylindrical cup-shaped screen has a screen bottom with a circumferential screen edge and an essentially cylindrical screen wall integrally bound to the screen bottom at the circumferential screen edge. The cup-shaped screen is slidably disposed through the beveled second open end and the elongated body of the conduit such that the circumferential screen edge essentially registers with the inward flange edge and a portion of the screen bottom flushes against the inward flange. A method for manufacturing a venting device comprising flanging the first open end of the conduit such that the first open has a circumferential structure defining an inward flange with an inward flange edge that defines the meeting point of the inward flange and the inside surface of the body wall. The second open end of the conduit is beveled such that the second open end has a circumferential structure defining a bevel. The method for manufacturing the venting additionally comprises sliding the generally cylindrical cupshaped screen through the beveled second open end and through the elongated body of the conduit until the screen is disposed against the inward flange such the circumferential screen edge essentially registers with the inward flange edge and a portion of the screen bottom flushes against the inward flange.

7 Claims, 7 Drawing Figures

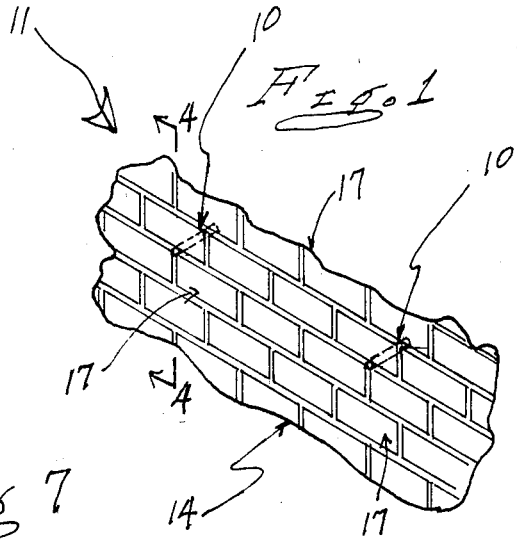
Fig. 1
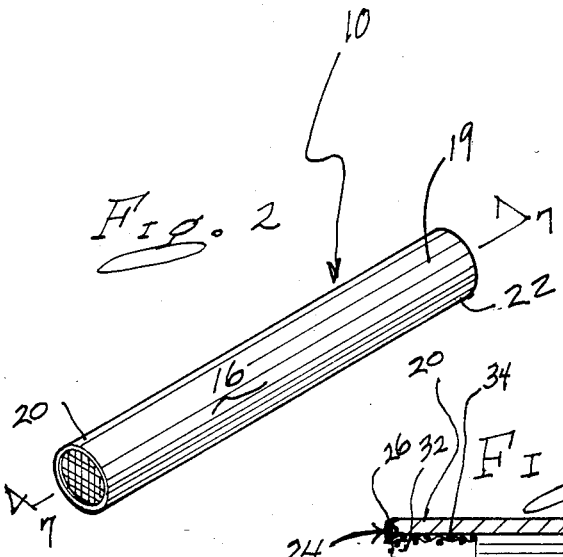
Fig. 2
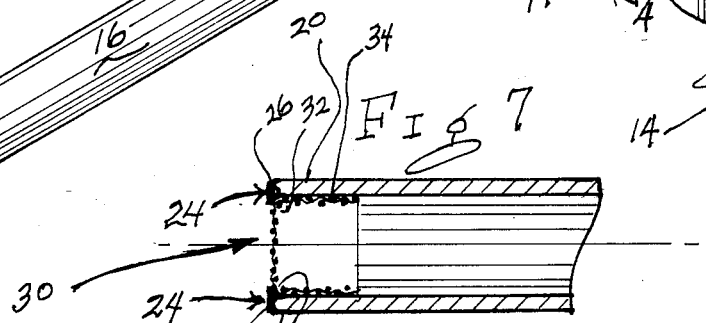
Fig 7
Fig. 3
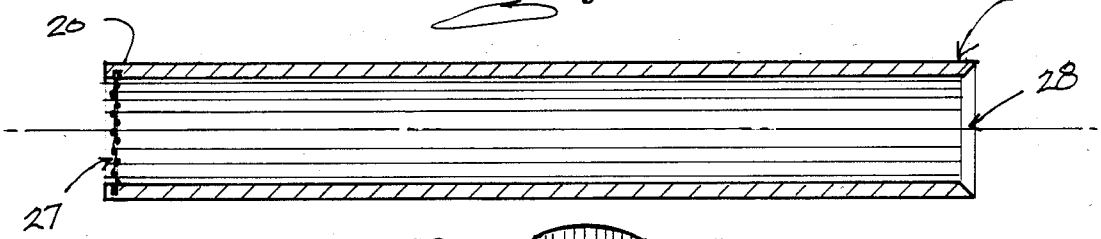
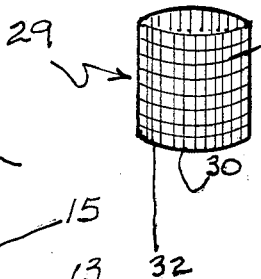
Fig 6
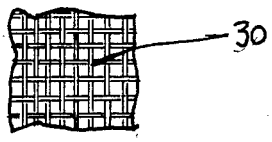
Fig. 5
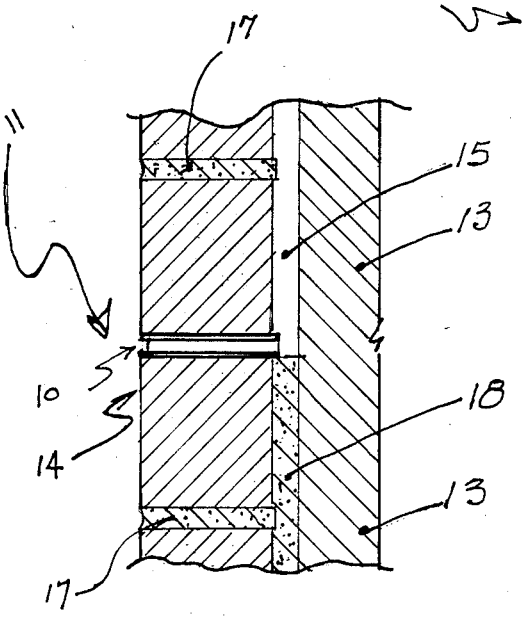
Fig. 4

VENTILATING DEVICE AND METHOD FOR MAKING THE SAME

BACKGROUND OF THE INVENTION

1. Field of the Invention

This invention is related to a ventilating device. More specifically, this invention provides a venting device for ventilating new masonry, stone, precast veneer, bricks, or the like, and a method for manufacturing the venting device.

2. Description of the Prior Art

U.S. Pat. No. 1,976,644 by Weil relates to a brick or masonry wall and the method of constructing the same. Weil's invention broadly resides in providing continuous or connected vertical and horizontal drainage and ventilating channels in a walling or masonry construction, and which bricks, stone, tile or other building blocks or masonry units are employed. U.S. Pat. No. 2,657,570 by Moore relates to improvements in wall ventilators, and particularly to walls of conventional concrete blocks or other walls provided with an air space. U.S. Pat. No. 2,709,402 by Malm discloses an improvement in ventilators and deals particularly with a device which may be mounted in walls and the light to provide the ventilation through the wall. U.S. Pat. No. 2,772,622 by Slower teaches a ventilator for hollow masonry walls, and particularly walls constructed of hollow concrete blocks and whereby the blocks provide a substantially hollow wall for its major height. U.S. Pat. No. 2,764,929 by Tegarty relates to venting devices and the like, and particularly to venting devices for installation in the outside walls or wooden buildings so as to provide a restricted passage therethrough which permit air to enter and discharge from the space between the inner and the outer walls. U.S. Pat. No. 2,868,010 by Murphy discloses improvements in ventilators for walls provided with air spaces, particularly concrete cell block walls, and the method of venting the walls. U.S. Pat. No. 3,429,084 by Brewer illustrates a duct assembly to permit circulation of air, and drain condensation from between walls and to prevent invation of insects. The duct assembly includes a screen and an ant trap chamber. U.S. Pat. No. 4,026,082 by Crowfoot relates to frames for vents in building walls. None of the foregoing prior art teach or suggest the particular venting device and method for making the venting device of this invention.

SUMMARY OF THE INVENTION

The present invention accomplishes its desired objects by broadly providing a venting device for ventilating new masonry, stone, precast veneer, or the like. The venting device comprises a conduit means having an elongated body with a body wall and a first open end and a second open end. The first open end has a circumferential structure defining an inward flange means with an inward flange edge that defines the meeting point of the inward flange means and the inside surface of the body wall. The second open end has a circumferential structure defining a bevel. A generally cylindrical cup-shaped screen means has a screen bottom with a circumferential screen edge and an essentially cylindrical screen wall integrally bound to the screen bottom at the circumferential screen edge. The cup-shaped screen means is slidably disposed through the beveled second open end and the elongated body of conduit such that the circumferential screen edge essentially registers with the inward flange edge and a portion of the screen bottom flushes against the inward flange means. The present invention also accomplishes its desired objects by broadly providing a method for manufacturing the venting device for ventilating new masonry, stone, precast veneer, or the like from a conduit means having an elongated body with a body wall and a first open and a second open end. The method comprises the steps of flanging the first open end of the conduit means such that the first open end has a circumferential structure defining an inward flange means with an inward flange edge that defines the meeting point of the inward flange means and the inside surface of the body wall. The second open end of the conduit means is beveled such that the second open end has a circumferential structure defining a bevel. The method for manufacturing additionally comprises sliding through the beveled second open end and through the elongated body of the conduit means a generally cylindrical cup-shaped screen means having a screen bottom with a circumferential screen edge and an essentially cylindrical screen wall integrally bound to the screen bottom at the circumferential screen edge; and disposing the cup-shaped screen means against the inward flange means such that the circumferential screen edge essentially registers with the inward flange edge and a portion of the screen bottom flushes against the inward flange means.

Therefore, it is an object of the present invention to provide a venting device for ventilating walls of a building structure.

It is another object of this invention to provide a method for manufacturing a venting device for ventilating new masonry, stone, precast veneer, or the like.

It is yet another object of this invention to provide a venting device which allows all surfaces behind newly constructed veneers to dry by ventilation and is economical to manufacture.

It is still yet another object of this invention to provide a venting device which is a quality solution for ventilating new masonry, stone, or precast veneer, and a neat method to replace weep joints in new or existing veneer construction.

These together with various ancillary objects and features which will become apparent to those skilled in the art as the following description proceeds, are attained by this novel venting device, a preferred embodiment being shown with reference to the accompanying drawings, by way of example only, wherein:

BRIEF DESCRIPTION OF THE DRAWINGS

FIG. 1 is a perspective view of a building structure disclosing the venting device of this invention about to be inserted through the masonry, or the like, of the building structure;

FIG. 2 is a perspective view of the venting device of this invention:

FIG. 3 is a vertical sectional view of another embodiment of the venting device of this invention;

FIG. 4 is a partial vertical sectional view taken in direction of the arrows and along the plane of line 4—4 in FIG. 1:

FIG. 5 is an enlarged top plan view of the bottom of the screen;

FIG. 6 is a perspective view of the generally cylindrical shaped screen; and FIG. 7 is a partial vertical sectional view taken in direction of the arrows and along the plane of line 7—7 in FIG. 2.

DETAILED DESCRIPTION OF THE DRAWINGS

Referring in detail now to the drawings, wherein like reference numerals designate similar parts of the invention, there is seen the ventilating device of this invention, generally illustrated as 10, for ventilating walls of a building structure, generally illustrated as 11. The building structure 11 includes an inside wall 13, an outside wall, generally illustrated as 14, and an air space 15 between the inside wall 13 and the outside wall 14. The ventilating device 10 is preferably utilized for ventilating the air space 15 behind the outside wall 14 with the atmosphere, especially a newly constructed outside wall 14 that may have mortar 17, or the like, for bonding new stones, bricks, masonry, or the like, into the building structure 11. The ventilating device 10 of this invention is a conduit 16 with an elongated body, generally illustrated as 18, having a body wall 19 and an open first end 20 and an open second end 22 (see FIGS. 2 and 3).

In a preferred embodiment of the invention, the open first end 20 preferably has a circumferential structure defining an inward flange 24 with an inward flange edge 26 that defines the meeting point of the inward flange 24 and the inside surface of the body wall 19 (see FIG. 7). The open second end 22 has a circumferential structure defining a bevel 28.

The venting device 10 of this invention also includes a generally cylindrical cup-shaped screen, generally illustrated as 29 (see FIG. 6), having a screen bottom 30 with a circumferential screen edge 32, and an essentially cylindrical screen wall 34 integrally bound to the screen bottom 30 at the circumferential screen edge 32. The screen 29 may be of any reasonable mesh size screen suitable to allow the air space 15 between the inside wall 13 and the outside wall 14 of a building structure 11 to breath with the atmosphere, yet small enough to keep out insects, or the like. Preferably the screen 29 is a 30 mesh size screen.

The cup-shaped screen 29 is slidably disposed through the beveled second open end 20 and the elongated body 18 of the conduit 16 such that the circumferential screen edge 32 essentially registers with the inward flange edge 26 and a portion of the screen bottom 30 flushes against the inward flange 24. Such posture of the screen 29 provides an insect, or the like, proof fitting between the screen 29 and the first open end 20 of the conduit 16. I have discovered that the inward flange 24 acts as an insect proof safety factor in the event that any of the screen wires sever from corrosion, or the like, at the screen edge 32 where the wires are bent. Any openings from severed wires along the screen edge 32 are covered by the inward flange 24. The embodiment of FIG. 3 of the conduit 16 does not offer this insect-proof safety factor. The screen 27 for this embodiment is not cup-like. In the event that any wires sever in proximity to the attachment point of the screen 27 for this embodiment with the inside wall of the open end 20, there is no inward flange 24 to cover the openings from the severed wire.

The elongated body 18 of the conduit 16 and the screen 28 are preferably manufactured of copper, which is basically non-corrosive. However, such preferential election for the material of my ventilating device 10 is not intended to limit the scope of my invention. The spirit and scope of my invention is intended to cover any suitable material for my screen 28, such as steel and steel alloys, iron and iron alloys, etc., and any other material for the elongated body 18 of my conduit 16, such as resin material, metal and/or metal/resin combined; moulded, extruded or roll formed.

With continuing reference to the drawings for the method of manufacturing my ventilating device 10, the first open end 20 of the elongated body 18 of my conduit 16 is flanged with a machine (not shown in the drawings) such that the first open end 20 has a circumferential structure defining the inward flange 24 with the inward flange edge 26 that, as was previously mentioned, defines the meeting point of the inward flange 24 and the inside surface of the body wall 19. The second open end 22 is beveled with a beveling machine or tool (not shown in the drawings) such that the second open end 22 has a circumferential structure defining the bevel 28. The generally cylindrical cup-shaped screen 29 is now slid through the beveled second open end 22 and through the elongated body 18 of the conduit 16 until it is disposed and/or flushed against the inward flange 24 such that the circumferential screen edge 32 essentially registers with the inward flange edge 26 and a portion of the screen bottom 30 flushes against the inward flange 24. Beveling of the second open end 22 is an important manufacturing function because it facilitates the sliding of the screen 29 through the second open end 22. Without the bevel 28 on the circumferential structure of the second open end 22, I have found that it is very difficult to slide the screen 29 through the second open end 22. The ventilating device 10 is now ready to be inserted through the mortar 17, or the like, of the outside wall 14 of the building structure 11 in order to ventilate the air space 15 between the inside wall 13 and the outside wall 14. The ventilating device 10 may be installed in the mortar 17 while the building structure 11 is being constructed, or it may be installed through the mortar 17 of an already constructed building structure 11.

My ventilating device 10 is a quality solution for ventilating new masonry, stone, or precast veneer, and a neat method to replace weep joints in new or existing veneer construction. The device 10 allows all surfaces behind newly constructed veneers to dry by ventilation, and allows relief from high heat build-up in air space while controlling expansion by ventilation. The ventilating device 10 of this invention, allows cold dry air to enter air space behind veneers and take up moisture in warm vapor passing from interior to exterior during heating season: thus is helps to prevent condensate build up in a wall between backup and veneer. My device 10 also equalizes air pressures on both sides of veneer; and when properly flashed, my ventilating device 10 acts as a weep for water which has penetrated the veneer.

While the present invention has been described herein with reference to particular embodiment thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A venting device for ventilating new masonry, stone, precast veneer, or the like, comprising a conduit means having an elongated body with a body wall and a first open end and a second open end, said first open end having a circumferential structure defining an inward flange means with an inward flange edge that defines the meeting point of the inward flange means and the inside surface of the body wall and said second open end having a circumferential structure defining a bevel;

a generally cylindrical cup-shaped screen means having a screen bottom with a circumferential screen edge and an essentially cylindrical screen wall integrally bound to the screen bottom at the circumferential screen edge;

and said cup-shaped screen means is slidably disposed through the beveled second open end and the elongated body of the conduit such that said screen bottom is substantially parallel with said inward flange means and the circumferential screen edge essentially registers with the inward flange edge and a portion of the screen bottom flushes against the inward flange means.

2. The venting device of claim 1 wherein said screen means is approximately 30 mesh in size.

3. A method for manufacturing a venting device for ventilating new masonry, stone, precast veneer, or the like, from a conduit means having an elongated body with a body wall and a first open end and a second open end, said method comprises the steps of:

(a) flanging the first open end of said conduit means such that said first open end has a circumferential structure defining an inward flange means with an inward flange edge that defines the meeting point of the inward flange means and the inside surface of the body wall;

(b) beveling the second open end of said conduit means such that said second open end has a circumferential structure defining a bevel;

(c) sliding through the beveled second open end and through the elongated body of the conduit means a generally cylindrical cup-shaped screen means having a screen bottom with a circumferential screen edge and an essentially cylindrical screen wall integrally bound to the screen bottom at the circumferential screen edge; and (d) disposing said cup-shaped screen means against said inward flange means such that said circumferential screen edge essentially registers with the inward flange edge and a portion of the screen bottom flushes against the inward flange means.

4. The method of claim 3 wherein said screen means is approximately 30 mesh in size.

5. The method of claim 3 additionally comprises inserting said manufactured venting device through the mortar, or the like, of an outside wall of a building structure, also having an inside wall and an air space between the inside wall and the outside wall, in order to ventilate the air space with the atmosphere.

6. The venting device of claim 1 wherein said screen wall is substantially perpendicular to said screen bottom.

7. The venting device of claim 6 wherein said screen wall is substantially parallel with respect to said inside surface of the body wall of the conduit means and flushes against a portion of the same.

* * * * *